US009777477B2

(12) United States Patent
Capati

(10) Patent No.: US 9,777,477 B2
(45) Date of Patent: Oct. 3, 2017

(54) PERGOLA PROVIDED WITH EXTENSIBLE ROOF SURFACE

(71) Applicant: Unopiu' S.p.A. Di Socio Unico, Rome (IT)

(72) Inventor: Roberto Capati, Rome (IT)

(73) Assignee: Unopiu' S.p.A. di Socio Unico, Rome (IT)

( * ) Notice: Subject to any disclaimer, the term of this patent is extended or adjusted under 35 U.S.C. 154(b) by 0 days.

(21) Appl. No.: 14/611,765

(22) Filed: Feb. 2, 2015

(65) Prior Publication Data

US 2015/0218807 A1 Aug. 6, 2015

(30) Foreign Application Priority Data

Feb. 5, 2014 (IT) ..... BS2014A0037

(51) Int. Cl.

| | |
|---|---|
| ***E04B 7/16*** | (2006.01) |
| ***E04B 1/19*** | (2006.01) |
| ***E04B 1/36*** | (2006.01) |
| ***E04H 15/58*** | (2006.01) |
| ***E04F 10/10*** | (2006.01) |

(52) U.S. Cl.

CPC ..... *E04B 7/166* (2013.01); *E04B 1/1903* (2013.01); *E04B 1/36* (2013.01); *E04F 10/10* (2013.01); *E04H 15/58* (2013.01); *E04B 2001/199* (2013.01)

(58) Field of Classification Search

CPC ..... E04B 7/166; E04B 1/36; E04B 1/1903; E04B 1/34305; E04B 1/34357; E04B 2001/199; E04H 15/00

See application file for complete search history.

(56) References Cited

U.S. PATENT DOCUMENTS

| | | | | |
|---|---|---|---|---|
| 3,512,315 A * | 5/1970 | Vitalini | ..... | E04B 1/3431 52/67 |
| 5,384,992 A * | 1/1995 | Roberton | ..... | 52/67 |
| 6,868,638 B1 * | 3/2005 | Gardner | ..... | 52/67 |
| 7,900,417 B1 * | 3/2011 | Leines | ..... | 52/650.3 |

FOREIGN PATENT DOCUMENTS

| | | | | |
|---|---|---|---|---|
| DE | 20 2013 105 010 U1 | 3/2014 | | |
| FR | 2 840 0006 | 11/2003 | | |
| JP | 2005334585 A * | 12/2005 | ..... | A47B 1/10 |
| JP | 2006-249677 | 9/2006 | | |

* cited by examiner

*Primary Examiner* — Patrick J Maestri
(74) *Attorney, Agent, or Firm* — Blank Rome LLP

(57) ABSTRACT

A pergola comprising a base module having a quadrangular support structure provided with vertical uprights connected to each other by at least one pair of rails and at least one transverse crossbeam connecting the pair of rails. The base module delimits a first roof surface. The pergola includes an extension module having a framework provided with at least one pair of struts. Each strut is at least partially vertically superposed on a corresponding rail, and is provided with at least one support leg that supports the overhanging framework on the side opposite the base module in the longitudinal direction. The extension module delimits a second roof surface at least partially superposed on the first. A guide structure is interposed between the struts and the rails for guiding a reciprocal longitudinal translation between the base module and the extension module, to modify the overall roof surface of the pergola.

12 Claims, 9 Drawing Sheets

PERGOLA PROVIDED WITH EXTENSIBLE ROOF SURFACE

BACKGROUND OF THE INVENTION

1. Field of the Invention

This invention relates to a pergola, in particular for outdoor environments, provided with an extensible roof.

2. Description of the Related Art

As is known, in the field of outdoor furniture, typically for gardens, there is widespread use of pergolas that comprise a support structure or frame, having a plurality of uprights and crossbeams that support a roof made, for example, with the use of cloth and the like.

In fact, the purpose of the pergola is to provide shelter or cover in outdoor environments, for example from sun, wind and rain. Pergolas can be self-supporting, i.e., provided with their own supports, or they may, at least partially, lean against supporting walls.

The known solutions involve the use of fixed-type pergolas, i.e., having a "fixed", unmodifiable, roof surface.

As a result, it is not possible to increase or decrease the roof surface area of the pergola or even change the footprint of the support structure or frame; the only option, in the solutions of the known art, consists in the removal of the roof and frame, for example by removing parts of the frame and removing and/or folding the cloth.

Even if the cloth can be folded or removed, the fact remains that the dimensions of the structure of the pergola of a known type, comprising uprights and crossbeams, cannot be changed without disassembly, which is quite inconvenient.

In solutions of pergolas not leaning and movable, for example provided with wheels, one can only move the pergola in order to optimize the space available when the pergola is not used.

In the light of the foregoing, it is clear that the users are forced to use pergolas of predetermined dimensions that, according to the specific use, may be oversized or undersized and that, when not in use, occupy excessive space.

SUMMARY OF THE INVENTION

Therefore, there is a need to solve the drawbacks and limitations mentioned in reference to pergolas of the prior art.

This need is met by a pergola according to claim 1.

BRIEF DESCRIPTION OF THE DRAWINGS

Further characteristics and advantages of this invention will be readily apparent from the following description of its preferred and non-limiting examples of embodiments, wherein.

The members, or parts of members, in common between the embodiments described below will be indicated with the same reference numbers.

DETAILED DESCRIPTION

Figure 1:
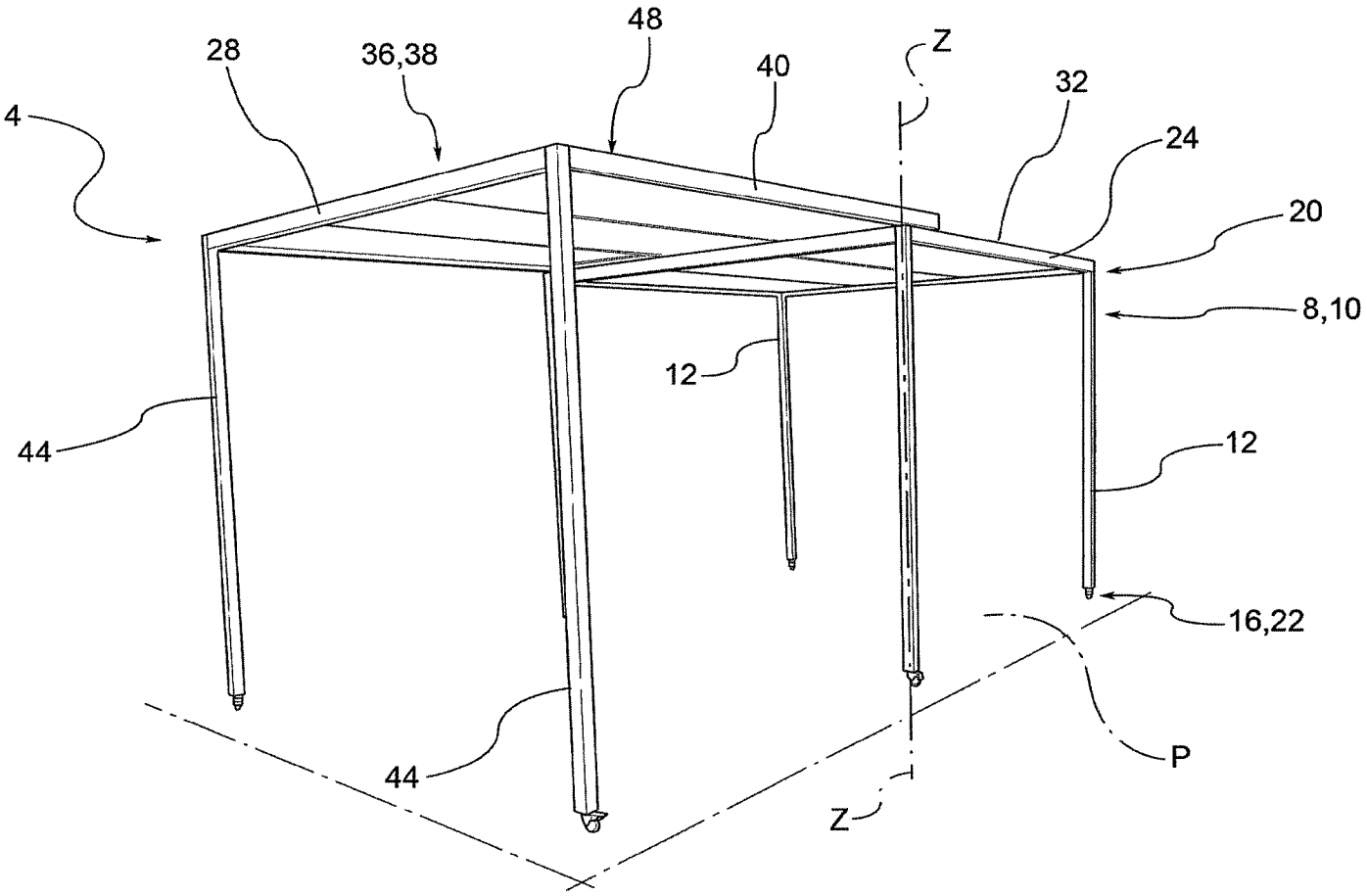
FIG. 1 is a perspective view of a pergola according to an embodiment of this invention.
Figure 2:
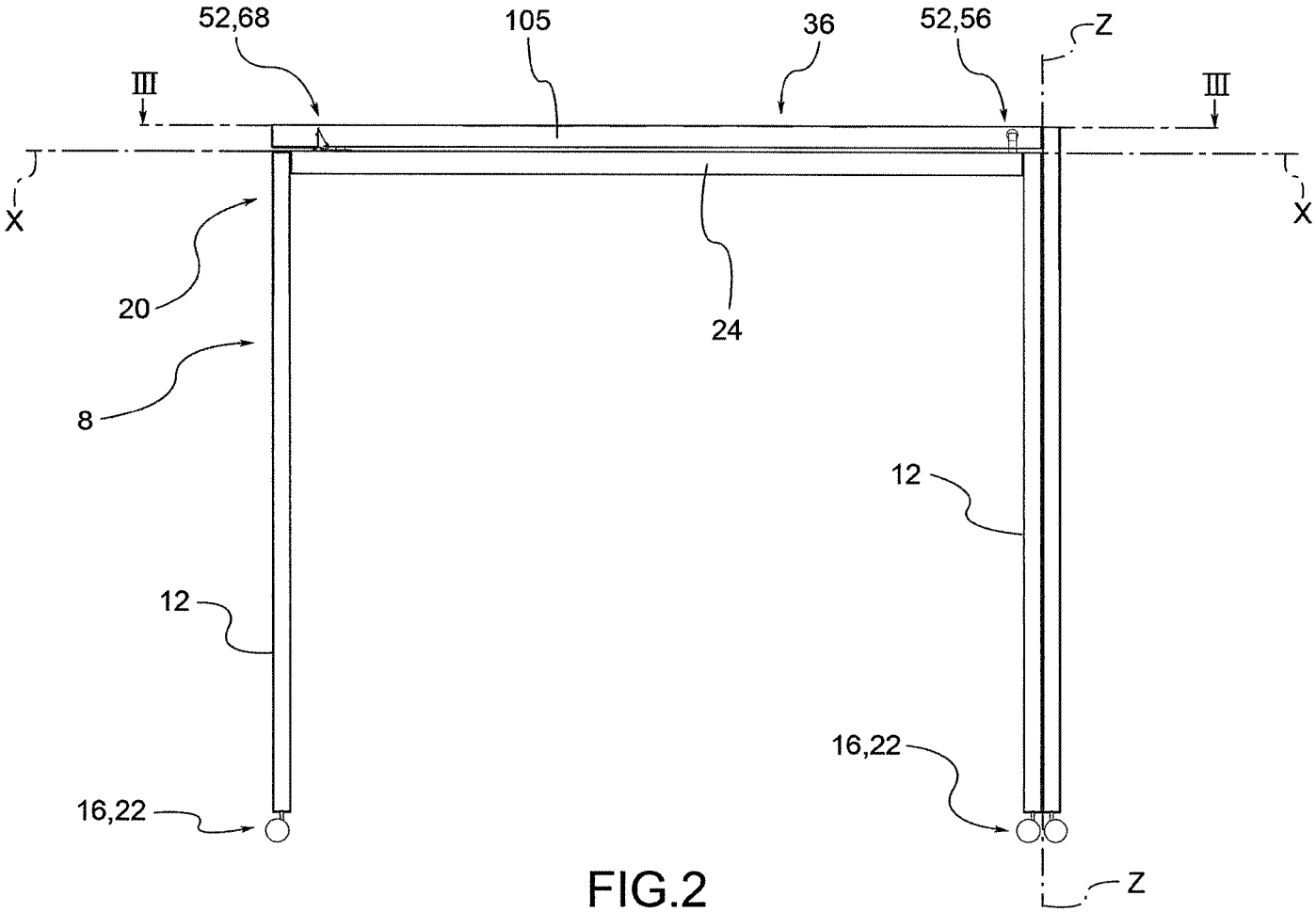
FIG. 2 is a side view, in partial section, of a pergola according to this invention, in closed configuration.
Figure 3:
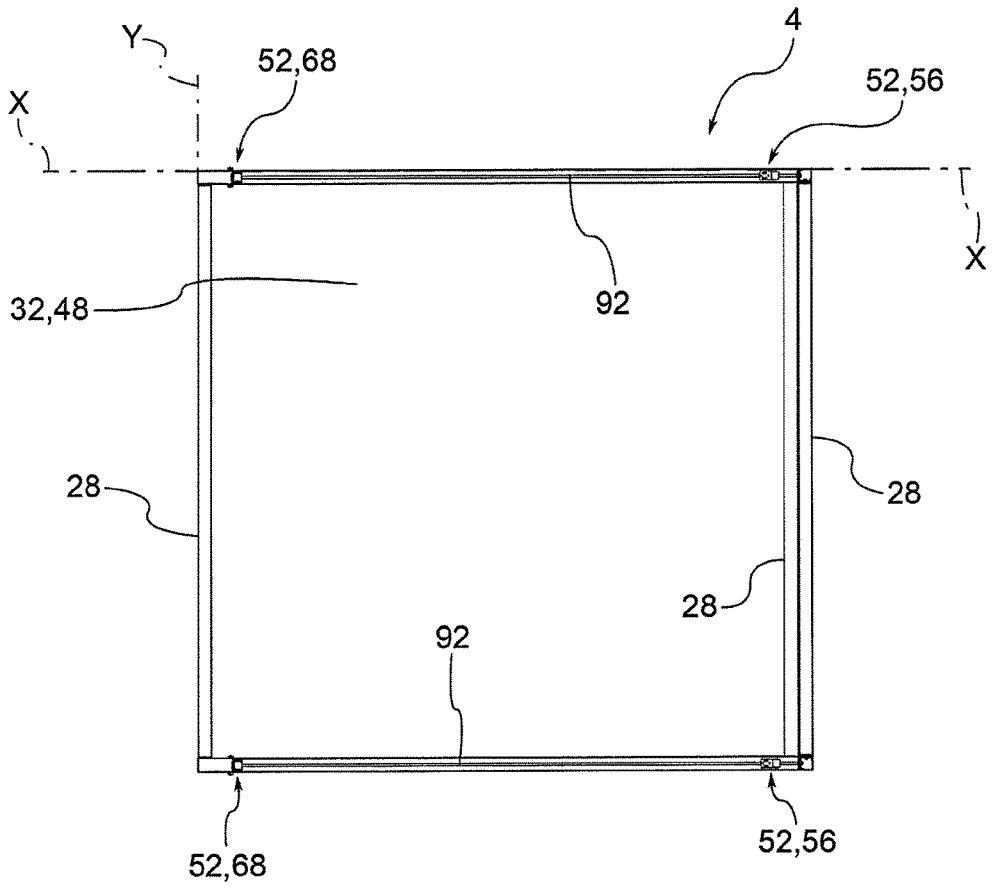
FIG. 3 is a sectional view of the pergola of FIG. 2, along the section plane of FIG. 2.
Figure 4:
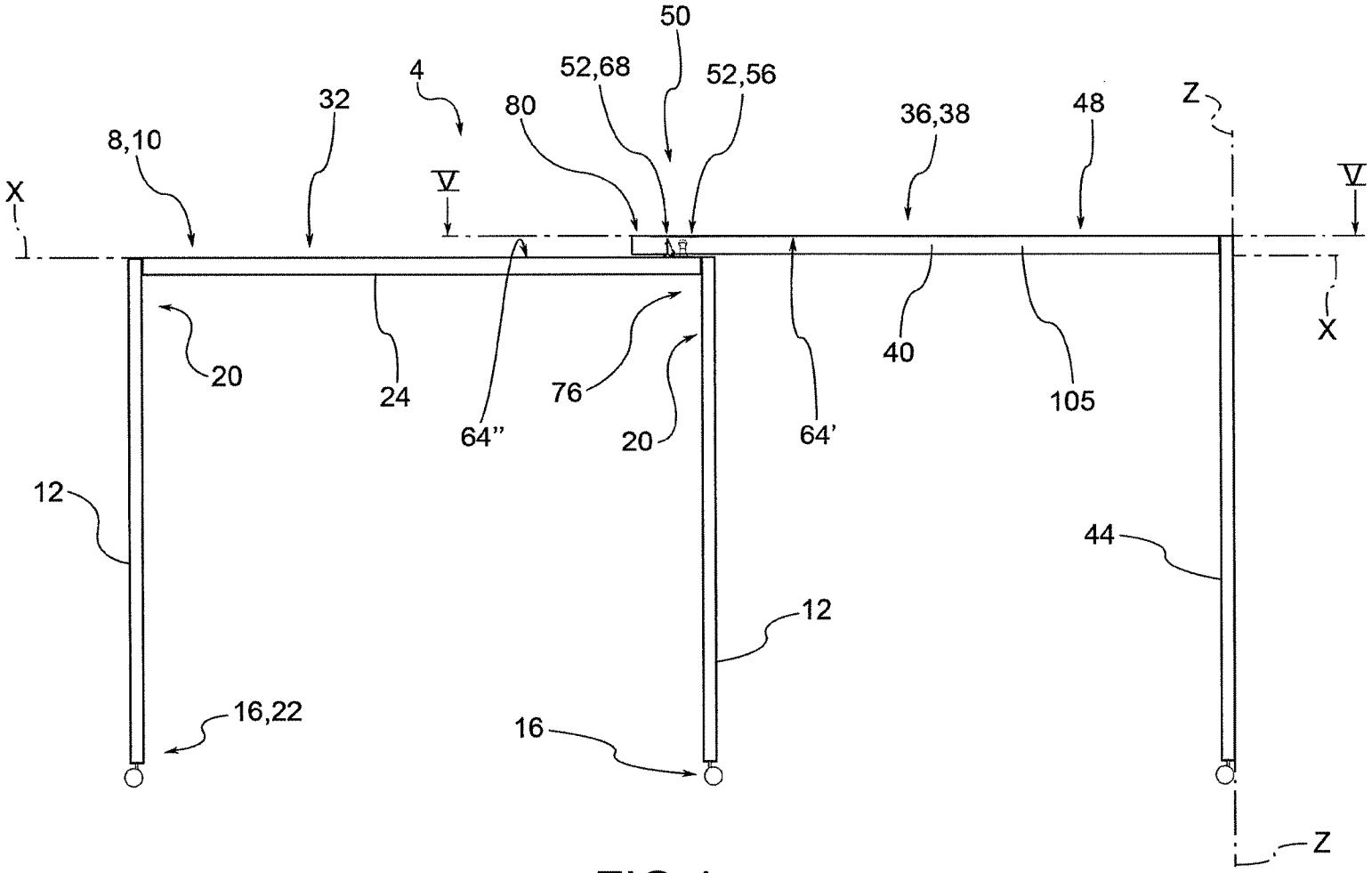
FIG. 4 is a side view, in partial section, of a pergola according to this invention, in open configuration.
Figure 5:
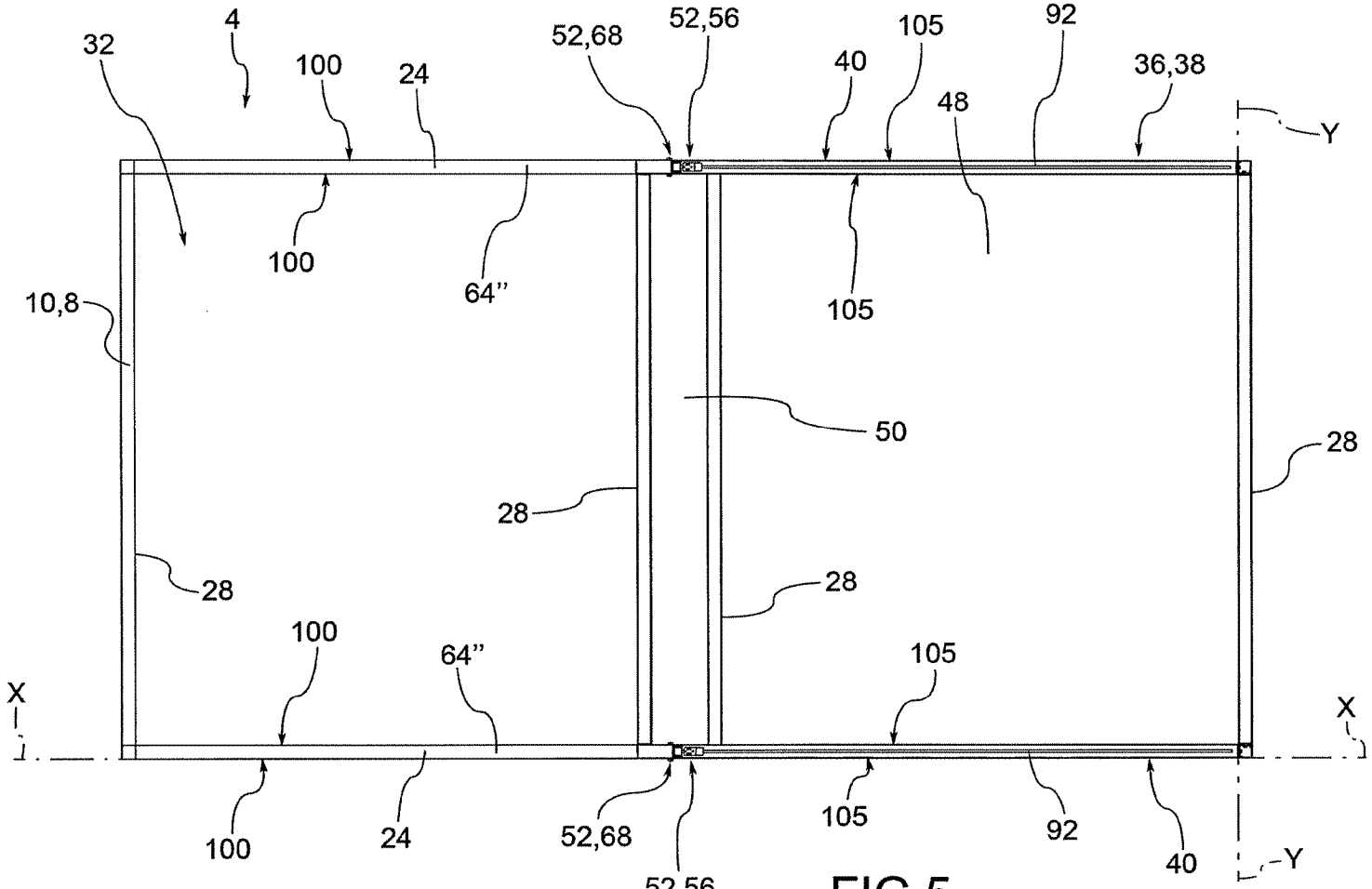
FIG. 5 is a sectional view of the pergola of FIG. 4, along the section plane V-V of FIG. 4.
Figure 6:
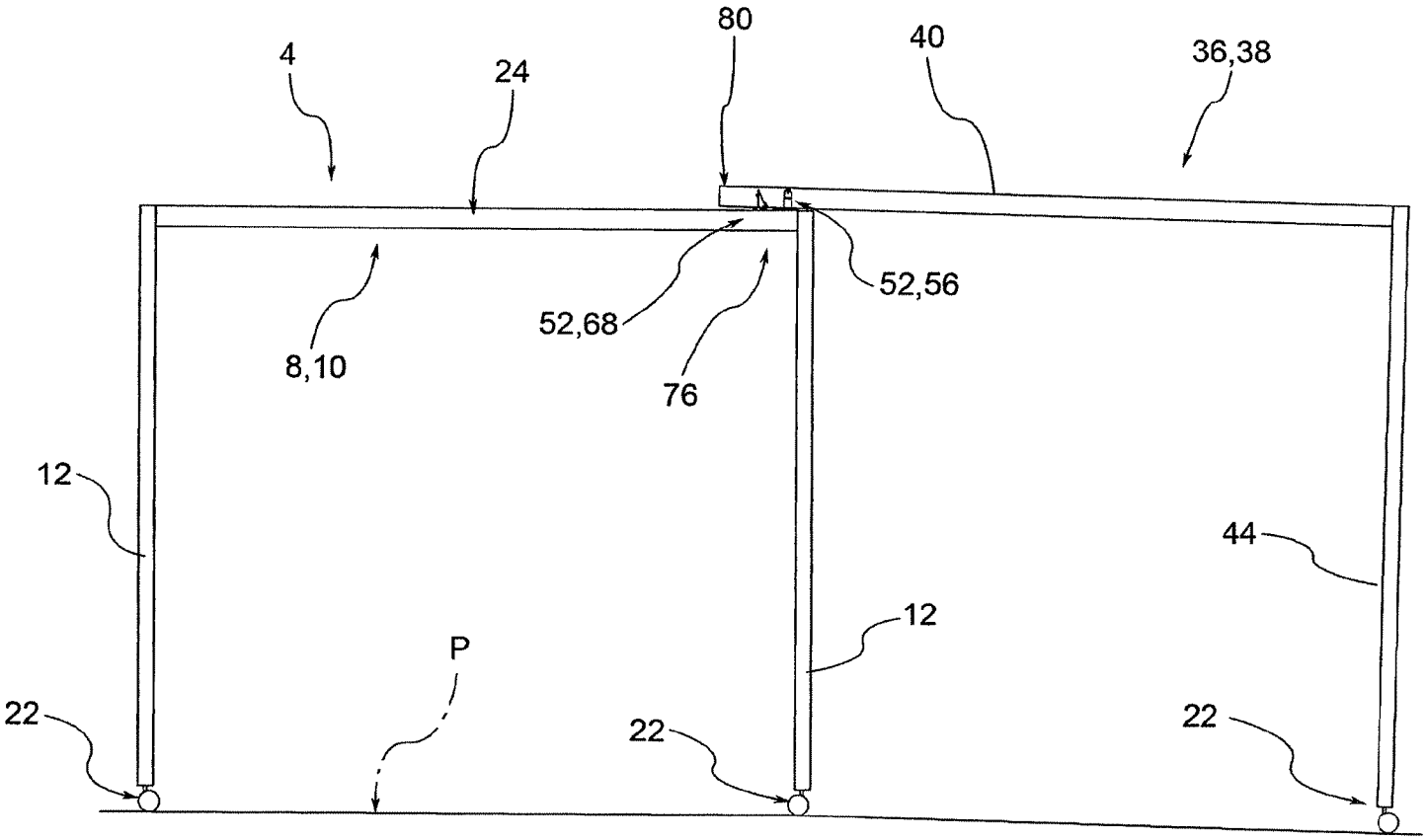
FIG. 6 is a side view, in partial section, of a pergola according to this invention, in use on a sloping terrain.

With reference to the above figures, 4 globally indicates a pergola comprising a first module or base module 8 comprising a quadrangular support structure 10 provided with uprights 12, extending from a lower end or foot 16 to an upper end 20 along a vertical direction Z-Z.

The vertical direction Z-Z is typically perpendicular to the support surface P of the pergola 4.

According to an embodiment, the feet 16 of the uprights 12 of the first module 8 are provided with swivelling or pirouetting castors 22.

The uprights 12 are connected to each other, in correspondence to said upper ends 20, by at least one pair of rails 24 directed along a longitudinal direction X-X and by at least one crossbeam 28 directed along a transverse direction Y-Y so as to connect said pair of rails 24.

The base module 8 defines a first roof surface 32 of the pergola 4.

The first roof surface 32, positioned in correspondence to the upper ends 20 of the uprights 12 and in correspondence to the crossbeams 28, can be provided with various types of roofs, such as for example perforated sheets, tarpaulins, bamboo reeds and wood-strip roofing. Preferably, these roofs are removable and interchangeable.

For the purposes of this invention, the material, shape, length and number of uprights 12 and crossbeams 28, as well as the type of the first roof surface, is not limitative.

Furthermore, the pergola 4 according to this invention can be of three types. In particular, the pergola can be "leaning", wherein the base module 8 has only two uprights 12, and the crossbeam 28 next to the wall is fixed directly to the wall with mechanical or chemical anchors for masonry.

In addition, the pergola 4 can be a fixed, self-supporting type: in this case, the four uprights 12 of the base module 8 are fixed in a manner integral with the ground by means of a fixing bracket to the ground.

Finally, the pergola 4 can be a movable, self-supporting type: in this case the four uprights 12 are provided with swivelling castors 22. To ensure the safety of the structure in case of wind, parking brackets, i.e., steels collars fixed to a wall, floor or railing, can be used to allow the temporary fixing (in a situation of safety) of the uprights 12 in case of wind.

The pergola 4 also comprises a second module 36, or extension module, having a framework 38 provided with at least a pair of struts 40, wherein each strut 40 is at least partially superposed on a corresponding rail 24 with respect to the vertical direction Z-Z.

The term "superposed" means that each strut 40 is offset with respect to the corresponding rail 24 along the vertical direction Z-Z, so as to be able to overlap with this.

Also the second module comprises crossbeams 28 that connect the struts 40.

According to a preferred embodiment, the second module comprises struts 40 having a longitudinal extension equal to the sum of the extension of the rails 24 of the first module 8 and the thickness of the two uprights 12.

The second module 36 is also provided with at least one support leg 44 that overhangingly supports said frame 38 on the side opposite to the first module 8 along the longitudinal direction X-X, the second module 36 delimiting a second roof surface 48 of the pergola 4 at least partially superposed on the first roof surface 32. The support leg 44 extends in turn from a lower end or foot 16 to an upper end 20, arranged on the side of the struts 40.

Superposition between the first and the second roof surface 32,48 with respect to the vertical direction Z-Z, means that said roof surfaces interpenetrate each other at least partially according to the degree of reciprocal opening or closing between the modules 8,36, i.e., according to the respective positions along the longitudinal direction X-X.

The second roof surface 48, positioned in correspondence to the upper ends 20 of the support legs 44 and in correspondence to the crossbeams 28, can also be provided with various types of roofs, such as for example perforated sheets, tarpaulins, bamboo reeds and wood-strip roofing. Preferably, these roofs are removable and interchangeable.

Preferably, the second module 36 comprises two support legs 44 aligned with respect to corresponding uprights 12 of the first module 8 along the transverse direction Y-Y.

According to an embodiment, the at least one support leg 44 of the second module 36 is provided with a foot 16 having a swivelling or pirouetting castor 22.

Between the struts 40 and the rails 24 guide means 52 are interposed for guiding a reciprocal movement of translation between the first and the second module 8,36 along the longitudinal direction X-X, to modify the overall roof surface of the pergola 4.

The overall roof surface of the pergola 4 means the sum of the useful roof surfaces provided by said modules 8,36.

The overall roof surface coverage is substantially equal to the sum of the roof surfaces 32,48 of the modules 8,36, with the exception of the superposed surface 50 between the two roof surfaces 32,48.

If the second module 36 is closed on the first module 8, the overall roof surface of the pergola 4 is less than the sum of the roof surfaces 32,48 of the modules 8,36 up to the case in which, having modules with equal roof surfaces that are completely superposed in the closed condition of the pergola 4, the overall roof surface is equal to that of the single module.

According to an embodiment, the guide means 52 comprise at least one balancing bracket 56 having a first roller or slide block 60 interposed between each strut 40 and each corresponding rail 24, said first roller or slide block 60 sliding in contact with a support surface 64',64" of a strut 40 or of a rail 24 during translation between the first and second module 8,36.

Preferably said first roller or slide block 60 is made of plastic material, such as, for example, Teflon, even of the reinforced type.

According to an embodiment, the guide means 52 comprise at least one sliding bracket 68 having a second roller or slide block 72 interposed between each strut 40 and each corresponding rail 24, said second roller or slide block 72 sliding in contact with a support surface 64',64" of a strut 40 or of a rail 24 during translation between the first and second module 8,36.

Preferably said second roller or 72 is made of plastic material, such as, for example, Teflon, even of the reinforced type According to an embodiment, said support surface 64',64" is flat and perpendicular to the vertical direction Z-Z.

The balancing bracket 56 and sliding bracket 68 are mechanically separated and independent of each other.

For example, the balancing bracket 56 and the sliding bracket 68 are fixed, one to a rail 24 and the other to the corresponding strut 40, in such a way that the bracket fixed to the strut 40 slides on a support surface 64" of the rail 24 and the bracket attached to the rail 24 slides on a support surface 64' of the strut 40.

Preferably, the balancing bracket 56 and the sliding bracket 68 are arranged so that each creates a unidirectional axial constraint to the reciprocal movement of said modules 8, 36 along the vertical direction Z-Z, in opposite directions from each other.

According to an embodiment, the balancing bracket 56 is integrally associated to each rail 24 of the first module 8 so as to have the first roller or slide block 60 in contact with a support surface 64' of the corresponding lower strut 40 of the second module 36.

In addition, the sliding bracket 68 is integrally associated to each strut 40 of the second module 36 so as to have the second roller or slide block 72 in contact with an upper support surface 64" of each rail 24 of the first module 8.

Preferably, in the assembly configuration of the modules 8, 36 of the pergola 4, the balancing bracket 56 of the first module 8 is interposed, with respect to the longitudinal direction X-X, between the sliding bracket 68 of the second module 36 and the at least one support leg 44 of the second module 36.

Preferably, the balancing bracket 56 is arranged in correspondence to each longitudinal end 76 of the rails 24 facing the second module 36, and the sliding bracket 68 is arranged in correspondence to an overhanging end 80 of each strut 40.

According to an embodiment, the balancing bracket 56 comprises a support plate 84, for example for fixing on the rails 24, and a support 88, fixed to the support plate 84, which rotatably supports the first roller or slide block 60.

Said first roller or slide block 60 is rotatably supported so as to present an axis of rotation parallel to said transverse direction Y-Y and perpendicular to the longitudinal direction X-X.

According to an embodiment, the struts 40 are at least partially hollow and are provided with grooves 92 so as to house, at least partially, the balancing bracket 56.

According to an embodiment, the sliding bracket 68 comprises at least one lateral guide 96 suitable to interface with the side walls 100 of said rails 24, in order to control or prevent transverse movements of the modules 8,36 along a transverse direction Y-Y, perpendicular to the longitudinal direction X-X and to the vertical direction Z-Z.

According to an embodiment, the balancing bracket 56 comprises at least one lateral guide 96 suitable to interface with the side walls 105 of said struts 40, in order to control or prevent transverse movements of the modules 8,36 along a transverse direction Y-Y, perpendicular to the longitudinal direction X-X and to the vertical direction Z-Z.

For example, the balancing brackets 56 and the sliding brackets 68 respectively arranged on rails 24 and struts 40 adjacent and associated with each other, are each provided with lateral guides 96 that abut on opposite side walls of the rails and struts 100, 105 in order to control or prevent transverse movements of the modules 8,36 along a transverse direction Y-Y, perpendicular to the longitudinal direction X-X and to the vertical direction Z-Z.

The lateral guides 96 can comprise slide blocks, rollers and the like. Preferably said slide block, rollers and the like are made of plastic material, such as, for example, Teflon, even of the reinforced type.

Figure 12:
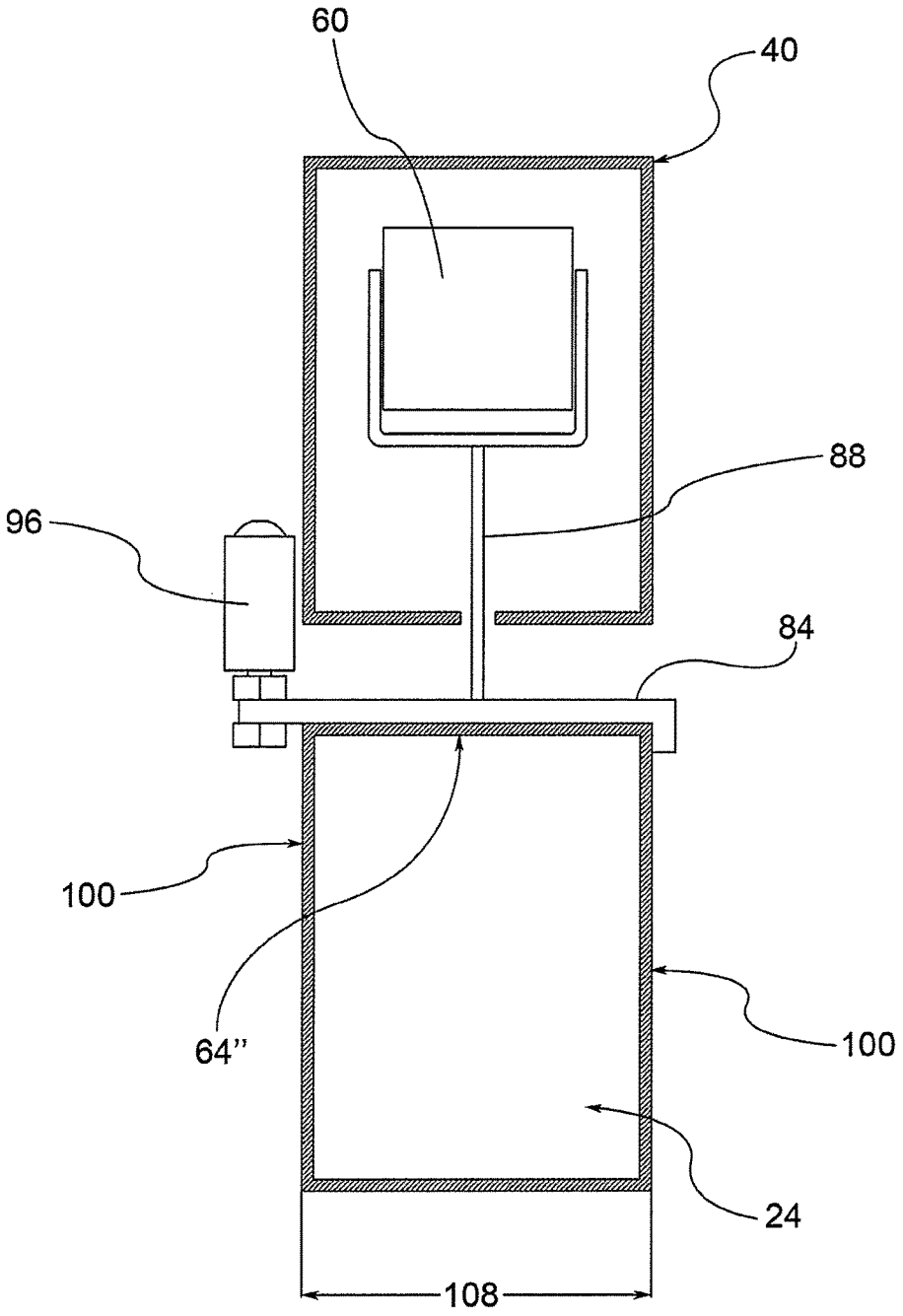
FIG. 12 is a sectional view of a detail of a pergola according to a further embodiment of this invention.

According to a further embodiment (FIG. 12), the sliding bracket 68 comprises a pair of lateral guides 96 suitable to interface with the side walls 100 of said rails 24, in order to control or prevent transverse movements of the modules 8, 36 along a transverse direction Y-Y, perpendicular to the longitudinal direction X-X and to the vertical direction Z-Z. For example, the lateral guides 96 are positioned so as to identify, between respective guide walls 104, a distance not less than a thickness or transverse width 108 of the rails 24.

Now, the operation of a pergola according to this invention will be described.

In particular, as shown, the pergola 4 comprises two modules 8,36 interconnected with each other so as to slide reciprocally towards or away from each other with respect to the longitudinal direction X-X, in order to modify the overall dimensions and the overall roof surface of the pergola 4.

The reciprocal sliding can occur both when the first module or the base module 8 is leaning or fixed self-supporting, in which case only the second module 36 will be able to slide with respect to the first module 8, and when the first module is movable self-supporting (and thus, in turn, movable).

Said reciprocal sliding takes place thanks to the presence of the first and second rollers or slide blocks 60,72 interposed between the rails 24 and struts 40.

In particular, the second roller or slide block 72 of the sliding bracket 68 fixed, for example, on the struts 40, abuts against the support surface 64" of the rails 24 so as to constitute the primary sliding guide of the second module 36; furthermore, the lateral guides 96 of the sliding bracket 68 abut against the side walls 100 of the rail 24 in order to avoid transverse skidding between the modules 8,36.

Preferably, the second module 36 comprises struts 40 superposed, with respect to the vertical direction Z-Z, on the rails 24: this superposition can be obtained, for example by using support legs 44 of the second module 36 which are higher, in the vertical direction Z-Z, than the uprights 12 of the first module 8 or even using different feet or swivelling casters 22 in order to obtain such a difference in height.

Figure 7:
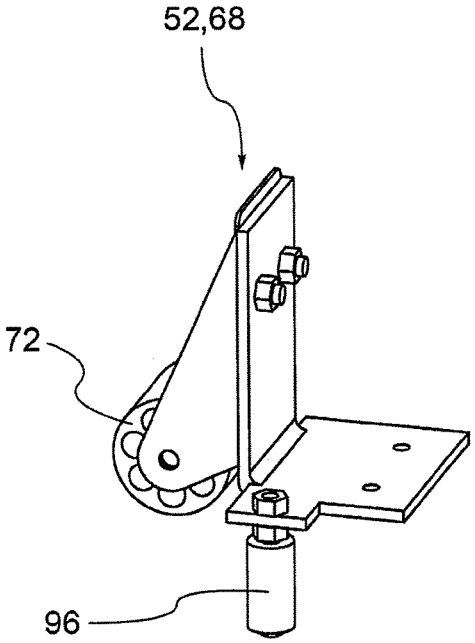
FIG. 7 is a perspective view, in assembly configuration, of a sliding bracket of the pergola according to this invention.
Figure 8:
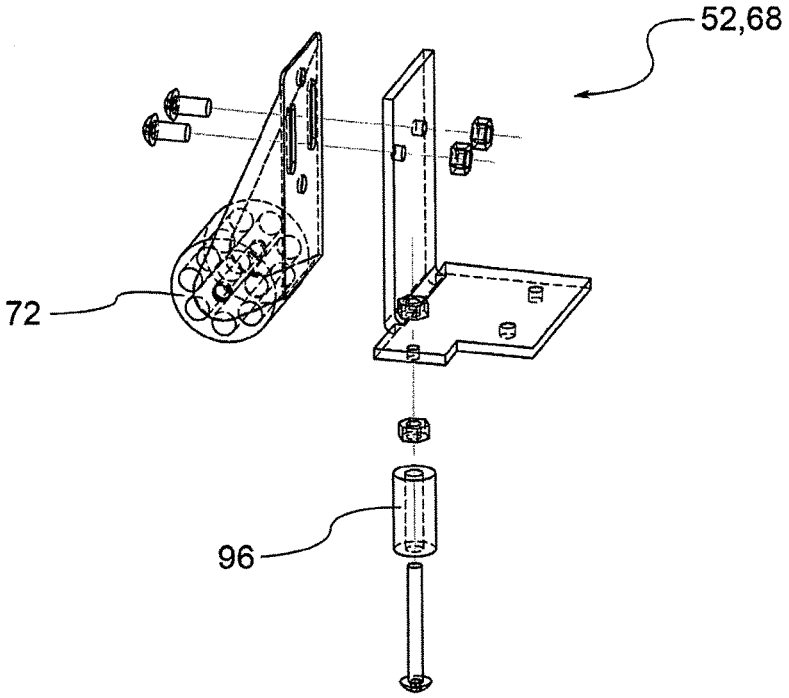
FIG. 8 is an exploded perspective view of the sliding bracket of FIG. 7.
Figure 9:
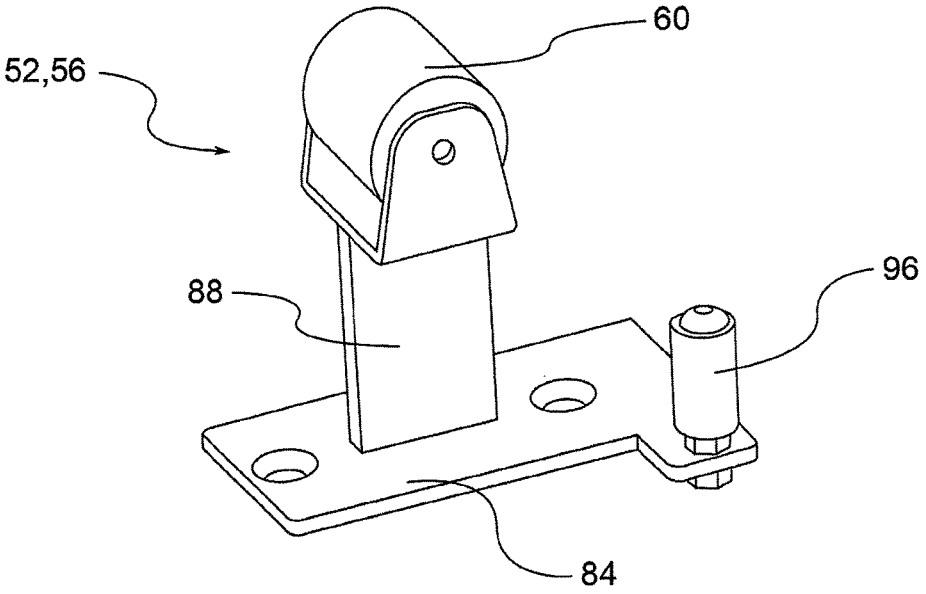
FIG. 9 is a perspective view, in assembly configuration, of a sliding bracket of the pergola according to this invention.
Figure 10:
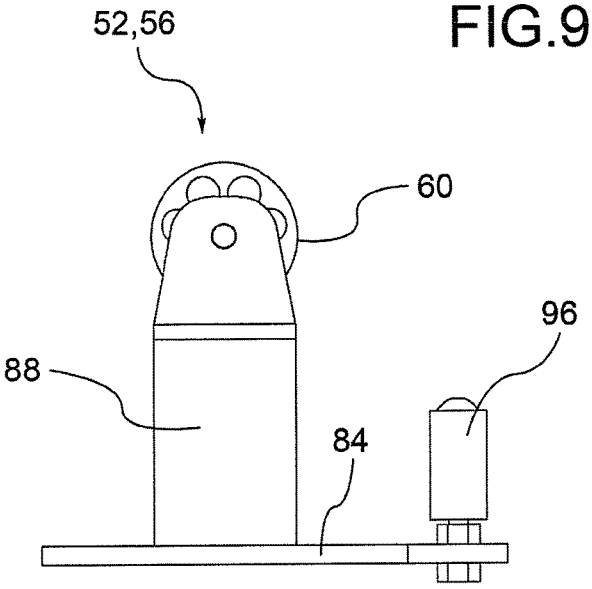
FIGS. 10-11 are side views, from different angles, of the balancing bracket of FIG. 9.
Figure 11:
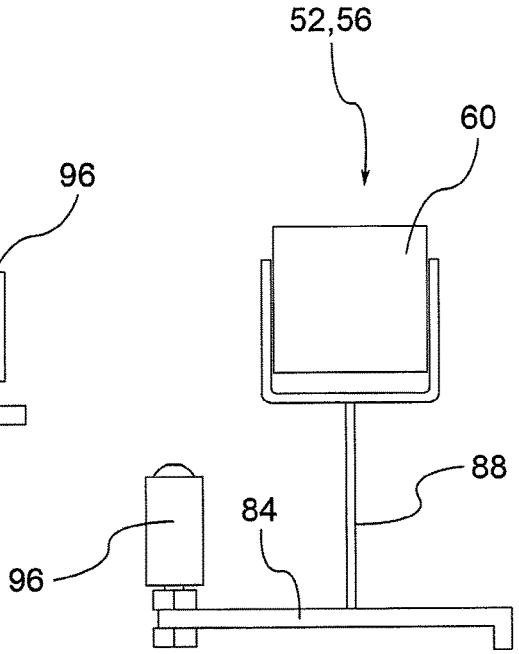

Furthermore, as shown, between the struts 40 and the rails 24 balancing brackets 56 are also interposed which serve to ensure proper sliding between the modules even in case of sloping or bumpy terrain, such as, for example, illustrated in FIG. 7. In fact, the first rollers or slide blocks 60 of the balancing brackets ensure a minimum distance between the rails 24 and struts 40 and prevent accidental contact even in case of bumps or slopes. To this end, the balancing brackets 56 are spaced as far apart as possible, along the longitudinal direction X-X, with respect to the sliding brackets 68, this distance being maximum in the maximum open configuration or related extension between the modules 8,36 and being minimum in the closed configuration of the modules themselves.

As can be appreciated from the description, the pergola according to the invention allows overcoming the drawbacks of the prior art.

In particular, the pergola according to the invention, whether it is self-supporting or leaning, allows modifying at will the extension of the roof, and also of the supporting structure, in a quick and practical manner without the use of tools.

In fact, it is possible to reciprocally slide the two structural modules in order to significantly increase or decrease both the overall size of the frame of the pergola and the extension of the roof.

It should be noted that the roof is increased or decreased without the need to fold the cloth of the roof, which is a rather laborious operation the pergolas of the prior art.

In addition, it is also possible to reduce the overall dimensions of the pergola without disassembling any components. It should be noted that to decrease dimensions by means of partial superposition of the modules of the pergola it is not necessary to disassemble the roof cloths.

The sliding devices between the modules always allow easy reciprocal movement of the modules, without skidding and ensuring high and long-lasting endurance of the mechanisms to the corrosive action of the weather and air pollution.

In fact, the pergola is designed for outdoor environments and must, therefore, ensure perfect sliding between the modules in any environmental condition: temperature, humidity, water, snow, salt, dirt, dust and so on.

In other words, the sliding mechanisms must be able to operate continuously, without jamming and without requiring special cleaning and/or maintenance, given also their difficult accessibility, since they are positioned at height with respect to the structure of the pergola.

Furthermore, the movement system must also ensure operation on any type of terrain, in particular in the presence of depressions, slopes and bumps.

In fact, pergolas are usually placed on outer ground, gardens or pavements that are sloped to facilitate the flow of rain water and are often uneven.

The sliding mechanism of the pergola also suitable to sloping and uneven terrain so as not to jam and to always ensure easy movement of the modules.

In fact, on the one hand the lateral guides prevent skidding and, on the other, the interaction between the sliding bracket and the balancing bracket allows, on the one hand, adapting the modules to uneven terrains and, on the other, avoiding crushing the crossbeams or rails of the rail.

In more detail, the sliding bracket ensures the sliding by means of a roller or a slide block that interfaces between the superposed rails and struts of the two modules, and by means of rollers or lateral guides that avoid warping or derailments of the rails or struts with respect to the transverse direction.

Moreover, the balancing bracket has the function of avoiding crushing or impact between the struts and rails of the superposed modules, in the case of uneven pavement, making it always possible to slide the modules.

A person skilled in the art, in order to satisfy contingent and specific needs, may make numerous modifications and variations to the pergolas described above, all however contained within the scope of the invention as defined by the following claims.

What is claimed is:

1. Pergola comprising:

a first module or base module comprising a support structure having a quadrangular base fitted with uprights, extending from a lower end or foot to an upper end in a vertical direction connected to each other, at said upper ends, by at least first and second rails directed in first and second longitudinal directions, respectively, and by at least one crossbeam directed in a transversal direction so as to connect said first and second rails, the base module delimiting a first roof surface of the pergola, and wherein the first and second longitudinal directions are parallel to each other, and a second module, or extension module, having a framework provided with at least first and second struts, wherein the first and second struts extend in third and fourth longitudinal directions, respectively, wherein the first strut is located directly over the first rail, and the second strut is located directly over the second rail, wherein the third and fourth longitudinal directions are parallel to the first and second longitudinal directions, and wherein the second module is provided with at least one support leg which supports said framework on the side opposite the first module in an extension direction, the second module defining a second roof surface of the pergola at least partially superposed to the first roof surface, and wherein the second module is movable relative to the first module in the extension direction to reduce the extent to which the second roof surface is superposed to the first roof surface, the extension direction being parallel to the first, second, third, and fourth longitudinal directions, wherein guide means are positioned between the first and second struts and the first and second rails to guide a reciprocal translation movement between the first module and the second module in the extension direction, to modify the overall roof structure of the pergola, the guide means comprising:

balancing brackets each having a first roller or slide block positioned between each strut and each corresponding rail, said first roller or slide block sliding in contact with a support surface of a strut or of a rail during the translation between the first module and the second module, and sliding brackets, mechanically separate and independent of the balancing brackets, each having a second roller or slide block positioned between each strut and each corresponding rail, said second roller or slide block sliding in contact with a support surface of a strut or of a rail during the translation between the first module and the second module, wherein the balancing brackets are fixed to the rails, and the sliding brackets are fixed to the struts, so that the brackets fixed to the struts slide on support surfaces of the rails and the brackets fixed to the rails slide on support surfaces of the struts, wherein the balancing brackets and the sliding brackets are positioned in opposite directions to each other so as to each form a unidirectional axial constraint to reciprocal movement of said first and second modules in a vertical direction, wherein the balancing brackets are vertically constrained relative to the rails, but are not vertically constrained relative to the struts, and wherein the sliding brackets are vertically constrained relative to the struts, but are not vertically constrained relative to the rails, such that the unidirectional axial constraints perm it the struts to become skewed, within respective planes, relative to the rails, as the at least one support leg of the second module is moved away from the first module, each plane being vertical and extending through the respective strut of the second module and the respective rail of the first module, and wherein the balancing brackets and the sliding brackets each comprise at least one lateral guide suitable to interface with respective side walls of said struts or rails, so as to control or prevent transversal movements of the modules in a transversal direction perpendicular to the extension direction and to the vertical direction.

2. Pergola according to claim 1, wherein said support surface is flat and perpendicular to the vertical direction.

3. Pergola according to claim 1, wherein each balancing bracket is integrally joined to a rail of the first module so as to position the first roller or slide block in contact with a lower support surface of the corresponding strut of the second module.

4. Pergola according to claim 1, wherein each sliding bracket is integrally joined to a strut of the second module so as to position the second roller or slide block in contact with an upper support surface of each rail of the first module.

5. Pergola according to claim 1, wherein, in an assembled configuration of the modules of the pergola, the balancing brackets are positioned, in a longitudinal direction, between the sliding brackets and the support leg of the second module.

6. Pergola according to claim 1, wherein at least one balancing bracket is positioned at a longitudinal end of each of the rails facing the second module, and at least one sliding bracket is positioned at an overhanging end of each strut.

7. Pergola according to claim 1, wherein each balancing bracket comprises a support plate for attachment to the rails, and a support, attached to the support plate, which supports a first roller or slide block in rotating manner.

8. Pergola according to claim 7, wherein said first roller or slide block is supported so as to rotate so as to present a rotation axis parallel to said transversal direction.

9. Pergola according to claim 7, wherein the struts are at least partially hollow and are provided with grooves so as to house at least partially the balancing bracket.

10. Pergola according to claim 1, wherein the second module comprises two support legs aligned in relation to corresponding uprights of the first module in a transversal direction.

11. Pergola according to claim 1, wherein the second module comprises struts having a longitudinal extension equal to that of the rails of the first module.

12. Pergola according to claim 1, wherein the feet of the uprights of the first module are fitted with swiveling castors or wherein the at least one support leg of the second module is fitted with a foot having a swiveling castor.

* * * * *